US010124223B1

(12) United States Patent
Porter

(10) Patent No.: US 10,124,223 B1
(45) Date of Patent: Nov. 13, 2018

(54) LOW-INTERFERENCE GOLF TEE SAVER SET

(71) Applicant: Robert N. Porter, Warr Acres, OK (US)

(72) Inventor: Robert N. Porter, Warr Acres, OK (US)

( * ) Notice: Subject to any disclaimer, the term of this patent is extended or adjusted under 35 U.S.C. 154(b) by 0 days.

(21) Appl. No.: 16/021,542

(22) Filed: Jun. 28, 2018

Related U.S. Application Data

(63) Continuation-in-part of application No. 15/382,634, filed on Dec. 17, 2016.

(51) Int. Cl.
*A63B 57/12* (2015.01)
*A63B 57/10* (2015.01)
*A63B 102/32* (2015.01)

(52) U.S. Cl.
CPC ..... *A63B 57/10* (2015.10); *A63B 2102/32* (2015.10)

(58) Field of Classification Search
CPC ..... A63B 57/10; A63B 57/12
See application file for complete search history.

(56) References Cited

U.S. PATENT DOCUMENTS 638,920 A * 12/1899 Grant ..... A63B 57/10 473/396
1,551,003 A 8/1925 Fawcett
1,554,229 A 9/1925 Parkhill
1,631,270 A 6/1927 Jones
1,655,751 A 1/1928 Codey
1,670,123 A 5/1928 Ranseen
2,011,203 A 8/1935 Seiki
2,668,710 A 2/1954 Carlson
3,606,344 A 9/1971 Ball
4,336,940 A 6/1982 Sprague
5,033,747 A 7/1991 Young
5,186,455 A 2/1993 Rosetta
5,211,395 A 5/1993 Liao
5,221,090 A 6/1993 Hong
D349,318 S 8/1994 Rubin
5,413,348 A 5/1995 Basso
5,720,677 A * 2/1998 Rudduck ..... B43K 29/004 473/387
5,820,490 A 10/1998 Hronas
5,890,976 A 4/1999 Anderson
(Continued)

OTHER PUBLICATIONS

USPTO; first office action dated Mar. 21, 2017, in parent U.S. Appl. No. 15/382,634.

(Continued)

*Primary Examiner* — Steven Wong
(74) *Attorney, Agent, or Firm* — Robert H. Frantz

(57) ABSTRACT

A golf tee set is provided with a keeper for preventing a tee from flying into a driving range or being lost, in which a first golf tee is tethered to a second golf tee, wherein a first point of attachment of the tether to the first golf tee is free of interfering force on at least the first golf tee, and wherein the tether is constructed of a filament having less weight, stiffness and resistance to twisting compared to a minimum weight, stiffness and resistance necessary to cause interference with the first golf tee loaded with a golf ball. The improved tether system avoids using holes in the tee, which can lead to breakage during play, and is removable to allow the user to select different tees for different game circumstances.

6 Claims, 8 Drawing Sheets

(56) References Cited

U.S. PATENT DOCUMENTS

| | | | | |
|---|---|---|---|---|
| D461,216 | S | 8/2002 | Luther, Sr. | |
| 6,494,796 | B2 | 12/2002 | Echaves | |
| 7,044,866 | B1 | 5/2006 | Blauvelt | |
| 8,167,741 | B1 * | 5/2012 | Murken | A63B 57/16 473/387 |
| 9,339,706 | B2 | 5/2016 | Black, Jr. et al. | |
| 9,358,440 | B1 | 6/2016 | Burrell | |
| 9,381,413 | B2 | 7/2016 | Carroll et al. | |
| 2002/0094887 | A1 | 7/2002 | Echaves | |
| 2002/0123396 | A1 | 9/2002 | Joo | |
| 2005/0130769 | A1 | 6/2005 | Olsen | |
| 2006/0229144 | A1 | 10/2006 | Lee | |
| 2007/0111825 | A1 | 5/2007 | Lee | |
| 2007/0298909 | A1 | 12/2007 | Lu | |
| 2011/0092316 | A1 | 4/2011 | Chiang Huang | |
| 2013/0267350 | A1 | 10/2013 | Koncelik, Jr. | |
| 2014/0162810 | A1 | 6/2014 | Park | |
| 2018/0169490 | A1 | 6/2018 | Porter | |

OTHER PUBLICATIONS

Porter, Robert; reply submitted on Jul. 20, 2017, to first office action dated Mar. 21, 2017, in parent U.S. Appl. No. 15/382,634.

USPTO; second office action dated Aug. 11, 2017, in parent U.S. Appl. No. 15/382,634.

Porter, Robert; reply submitted on Nov. 19, 2017, to second office action dated Aug. 11, 2017, in parent U.S. Appl. No. 15/382,634.

USPTO; third office action dated Dec. 7, 2017, in parent U.S. Appl. No. 15/382,634.

Porter, Robert; reply submitted on Feb. 10, 2018, to third office action dated Dec. 7, 2017, in parent U.S. Appl. No. 15/382,634.

USPTO; fourth office action dated Mar. 29, 2018, in parent U.S. Appl. No. 15/382,634.

E-Zlok; "E-Z Hex [TM] threaded insert for soft wood—flush—8-32×10mm"; retrieved on Jun. 21, 2018 from https://www.ezlok.com/ezhex-insert-800832-10.

Spiderwire' "Spiderwire Stealth [TM] Smooth"; retrieved on Jun. 20, 2018 from http://www.spiderwire/com.

MyGolfWay.com; "Tee Caddy—A great invention for never losing your tee again!", retrieve on Nov. 17, 2016 from http://www.mygolfway.com/en/tee-caddy-great-invention-never-losing-tee/.

Telegraph; "Patently Great: a silent car and a golf tee for life"; retrieved on Nov. 17, 2016 from http://www.telegraph.co.uk/men/the-filter/10331777/Patently-Great-a-silent-car-and-a-golf-tee-for-life.html.

NeverLostGolf.com; "The NeverLostGolf Tee Saver"; retrieved on Nov. 17, 2016 from http://www.neverlost.com/.

* cited by examiner

LOW-INTERFERENCE GOLF TEE SAVER SET

This is a continuation-in-part of U.S. patent application Ser. No. 15/382,634, filed on Dec. 17, 2016, by Robert N. Porter.

FIELD OF THE INVENTION

The invention generally relates to devices to keep golf tees from being lost or ejected into a driving range.

BACKGROUND OF INVENTION

When driving a golf ball, a golfer places a golf tee into the ground, tops it with a golf ball, and then strikes the ball with a club. Usually, the golfer's swing is inexact, and a portion of the face of the club strikes the tee, lifting it out of the ground and sending it flying, too. This can result in loss of the tee, as its direction and distance is much less predictable than the ball. And, players may lose time looking for lost tees, further slowing play and the amount of golfers who may enjoy a golf course during a given period of time.

SUMMARY OF EXEMPLARY

Embodiments of the Invention

A golf tee set is provided with a keeper for preventing a tee from being lost during play on a golf course and from flying into a driving range. A first golf tee is tethered to a second golf tee, wherein a first point of attachment of the tether to the first golf tee is free of interfering force on at least the first golf tee, and wherein the tether is constructed of a filament having less weight, stiffness and resistance to twisting compared to a minimum weight, stiffness and resistance necessary to cause interference with the first golf tee loaded with a golf ball. The improved tether system avoids using holes in the tee, which can lead to breakage during play, and is removable to allow the user to select different tees for different game circumstances.

BRIEF DESCRIPTION OF THE DRAWINGS

The description set forth herein is illustrated by the several drawings.

DETAILED DESCRIPTION OF EXEMPLARY EMBODIMENT(S) OF THE INVENTION

Figure 1:
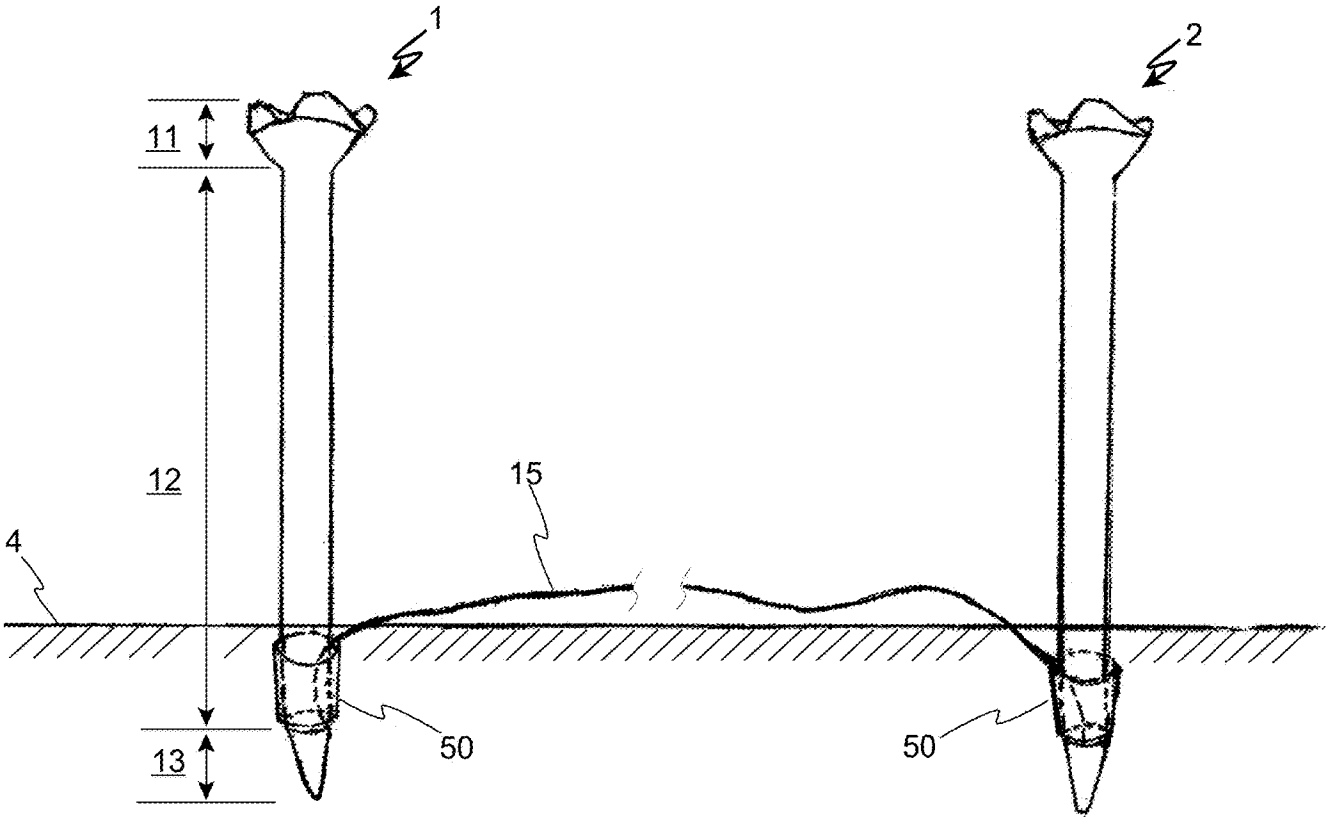
FIG. 1 shows an exemplary embodiment according to the present invention.

Various embodiments of the present invention will prevent losing a golf tee, and in at least one embodiment, will provide a set of different length tees. While other devices exist which prevent a tee from flying freely upon a drive, each of them exhibits at least one undesirable characteristic. For example, some tees keepers are flexible, however, the present inventor has recognized that they are not supple enough to prevent the tee keeper from exerting some amount of force on the tee, such as pushing or twisting, which is believed to possibly cause inaccuracy in the tractor of the ball. At ranges of 75 yards or more, even a small amount of hook, slice, topping or other interference can result in measurable and undesirable results of the drive. Because many golfers are acutely aware of this, they will not purchase or use a product which even appears visually to potentially interfere with their "swing". For example, newer golf tees now have 3 or 4 fingers which hold the ball, rather than the traditional cupped circular indentation, on the theory that the fingers make less contact with the ball, and therefore, provide less interference with the striking of the ball. Tee keeper devices known in the past typically provide a large visual distraction to players, and therefore, have not been widely adopted in the marketplace. Some available tee keepers exert considerable force on the tee, such as twisting resistance, so the visual impact (distraction) is compounded by very real physical harm to play.

The present inventor has also discovered that many golfers try to accurately sink their tees into the turf at a consistent depth, which leaves the seat for the ball at a consistent height from the turf. In this manner, these golfers believe their drive swing is improved because the distance between the ball and their shoulders is consistent and well-practiced. Several devices are currently on the market which allow a golfer to mark his or her tees for consistent depth or height setting, and some devices even work alongside of a tee as it is being planted to prevent its being planted too deeply. The success of these devices in the marketplace reflects golfers' beliefs that consistent height setting of a tee is important. Some tee saving or tee keeping devices, however, may interfere with the setting of the tee height, wherein some of them are large enough around the shank of the tee to prevent the tee from being planted beyond a depth in which the tee saver might contact the ground.

The present inventor has further realized that, even though golf can be a very expensive game to play, many players are very cost conscious and will avoid purchasing anything which is too expensive for the function provided, or which appears to be gimmicky or just a gadget.

Therefore, the present inventor has recognized a need for a tee saving or tee keeping device which provides one or more of the following advantages:

- it avoids causing a visual distraction to normal play when a ball is teed up (e.g., it doesn't look different from regular play);
- it avoids exerting appreciable mechanical force on the tee when the ball is teed up (e.g., it doesn't feel different than planting a tee normally);
- it does not provide real or apparent force while the ball is being struck;

it does not interfere with a players desired depth planting of a tee;

it prevents players at driving ranges from dangerously walking into the range area to retrieve tees;

it allows a player to change or replace the tees in the set without having tie any knots; and its design enables cost effective manufacturing commensurate with retail costs of similar tee-related products.

Further, in at least one embodiment according to the present invention, the tee saver provides the player with two or more tee lengths or tee types, thereby doubling as a set of tees as well as a tee saver, which provides greater economic advantage and requires less room in the golfer's golf club bag or pocket.

Turning to FIG. 1, a first embodiment according to the present invention is shown in which a first tee (1) is tethered (15) to a second tee (2). Each tee used for embodiments of the present invention has three distinct mechanical portions: a crown portion (11) for receiving a golf ball, a shank portion (12) for planting into the turf and holding the ball above the turf, and a point portion (13) for reducing the amount of force needed to plant the tee, especially in hard or dry soil. Modern tees have these three portions of the tee, wherein the point portion has a considerably greater taper than the shank portion has. Some shank portions are slightly tapered, but some are also parallel (non-tapered). Some older tee designs simply provide a combined shank and point portion, and generally are not suitable for realization of the present invention, and generally are not used in modern play of golf because they tend to be unstable. For example, when the shank and point are integrated into one long, tapered portion, if the golfer initially drives the tee too far into the turf and then slightly lifts the tee up to desired height, the hole formed in the ground is now larger than the portion of the tee still in the hole. At that point, the tee tilts to one side or another, and may not securely hold the ball. For these reasons, such tee shapes are not seen in widespread use, and the present invention is generally not intended for use on such tee shapes.

In this exemplary embodiment of FIG. 1, the tether (15) is secured to each tee (1, 2) using a barrel (50) affixed around the lower shank portion (12) immediately above the tip portion (13), wherein the shank portion and the tip portion have significantly different tapers. In this particular configuration, either tee can be used as the playing piece, while the other tee can be used as an anchor. Usage of a very flexible tether material, such as 20-pound test Spiderwire™ Stealth™ Smooth (manufacturer part number SCSM20G-125) or equivalent (Trilene™, etc.) multi-filament fishing line, has been found by experimentally by the present inventor to provide no discernable interfering force on the tee, and to survive the force of long drives imparted onto the tee. Further, the components and steps in manufacturing are relatively inexpensive, and the tether is thin enough to avoid its interring with the player's desire to plant the tee as deeply into the ground as he or she wishes.

Figure 2A:
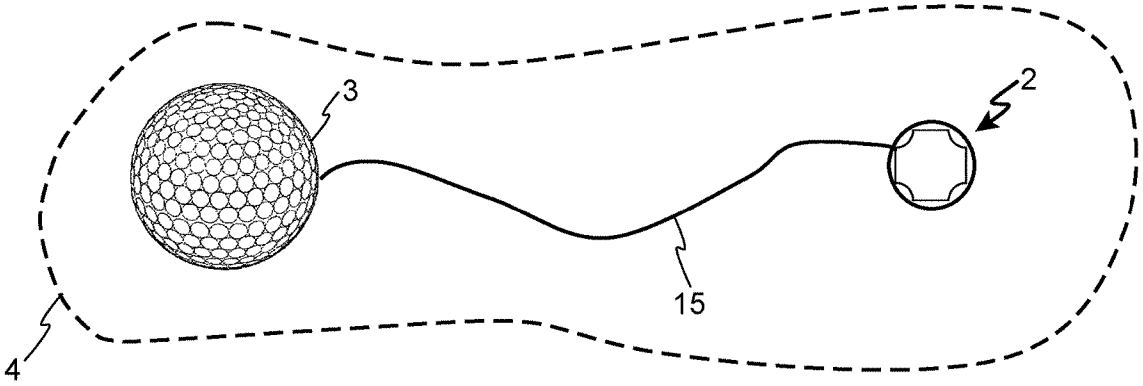
FIGS. 2A and 2B provide a top view and a side cutaway view of an exemplary embodiment in play prior to a drive of a golf ball.
Figure 2B:
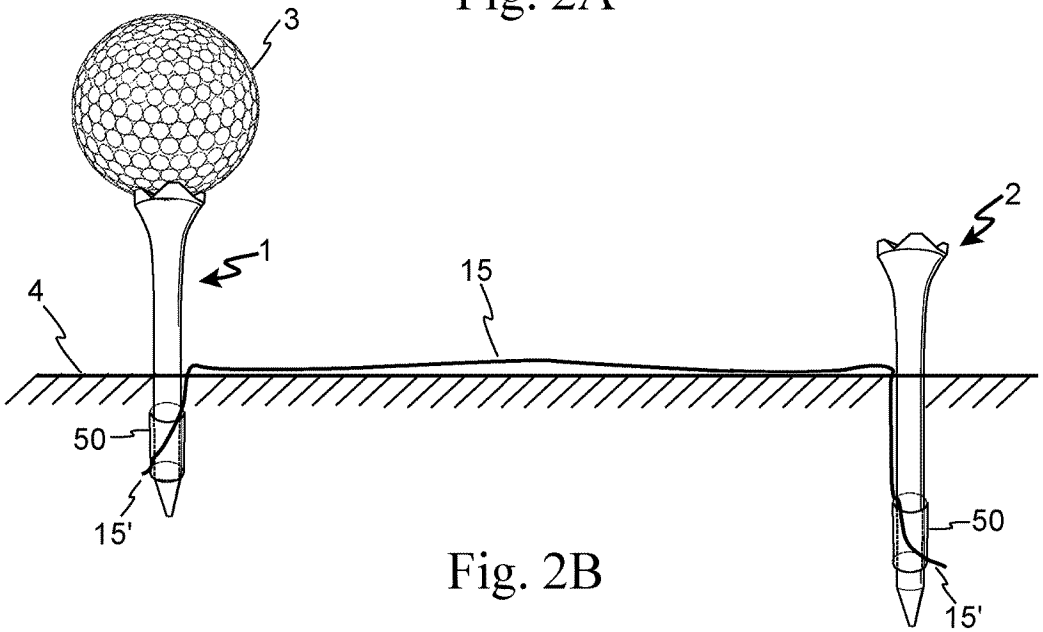

FIG. 2B shows a side view and FIG. 2A shows a top-down view of the embodiment of FIG. 1 in a teed-up state. The first tee (1) is used as the playing piece, and in this depiction, it has been planted into the turf (4) with the most of the shank above ground level, and at least the lower shank covered by the barrel (50) and tip (15) below the surface of the ground (4) to conceal the barrel and tether connection point from view of the player, thus eliminating visual distraction to normal play, as can be seen from the top-down perspective (a) in FIG. 2.

The tether (15) is dressed loosely along the turf to the second tee (2), which is planted as an anchor into the ground (4). By placing the anchor sufficiently far away from the playing piece to avoid the club striking the anchor, while also leaving plenty of slack in the tether, the player is visually assured that the tether is exerting no interfering mechanical force onto the playing piece tee (1), thus reducing the real and mental impact of the device on play of the game.

The length of the tether (15) can vary depending on the player's preference, however, the present inventor has found a length of 8 to 12 inches to provide sufficient space between the playing piece and the anchor while avoiding extra bulk when the pair is placed in a player's pocket.

Figure 3A:
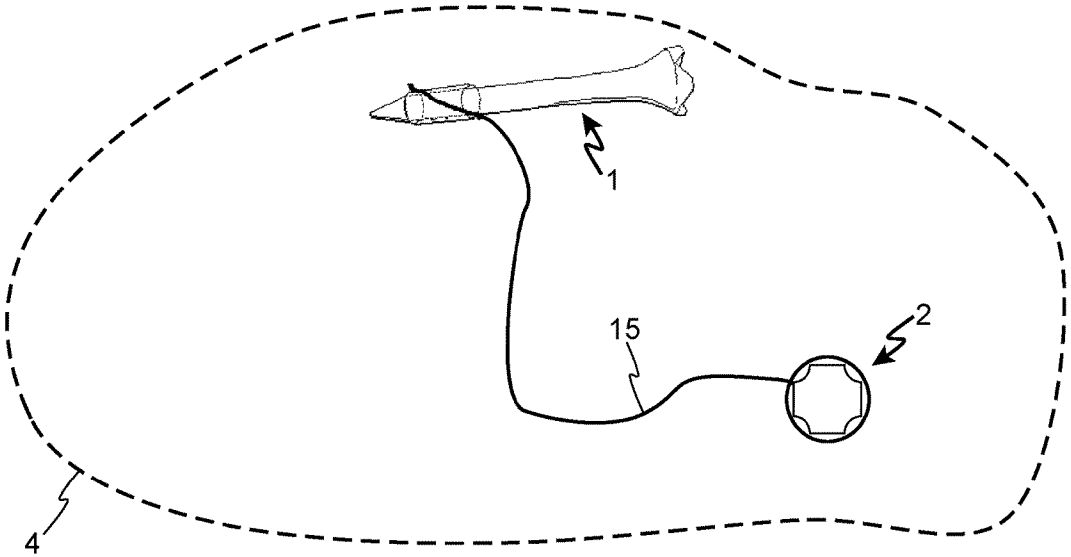
FIGS. 3A and 3B illustrate a top view and a side cutaway view of an exemplary embodiment subsequent to driving a golf ball.
Figure 3B:
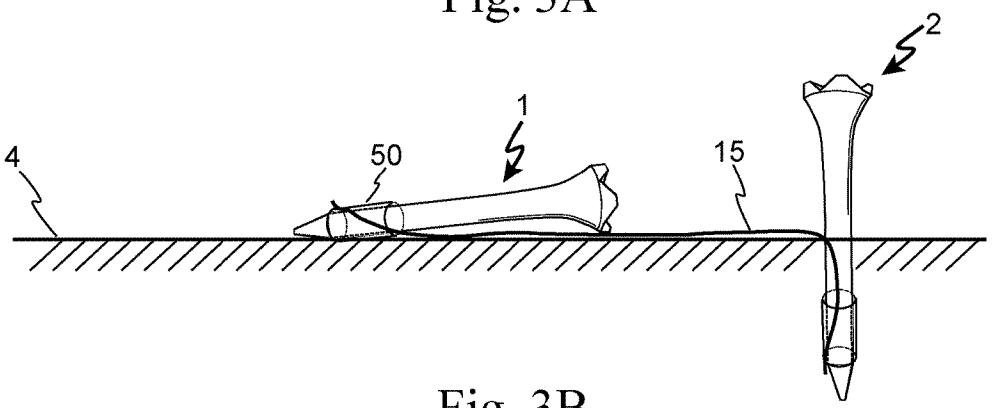

The tee keeper is shown in a post-drive mode, also in a side view FIG. 3B and a top-down view FIG. 3A. In this mode, the ball is no longer visible because it has been driven down range, and the playing piece tee (1) has been knocked out of the ground (4) and forward, but the anchor tee (2) has remained in the ground (4). Just after impact of the club on the ball, the playing piece tee (1) flies freely from the ground without interference from the tether (15) until it reaches a distance from the anchor tee (2) equal to the length of the tether (15). At this point, the forward motion of the playing piece (1) is stopped, and it drops to the turf (4), as shown (a). Now, the player can easily retrieve both tees (1, 2), wind or wad up the tether, and place the pair of tees into his or her pocket or golf club bag for compact storage.

Figure 4:
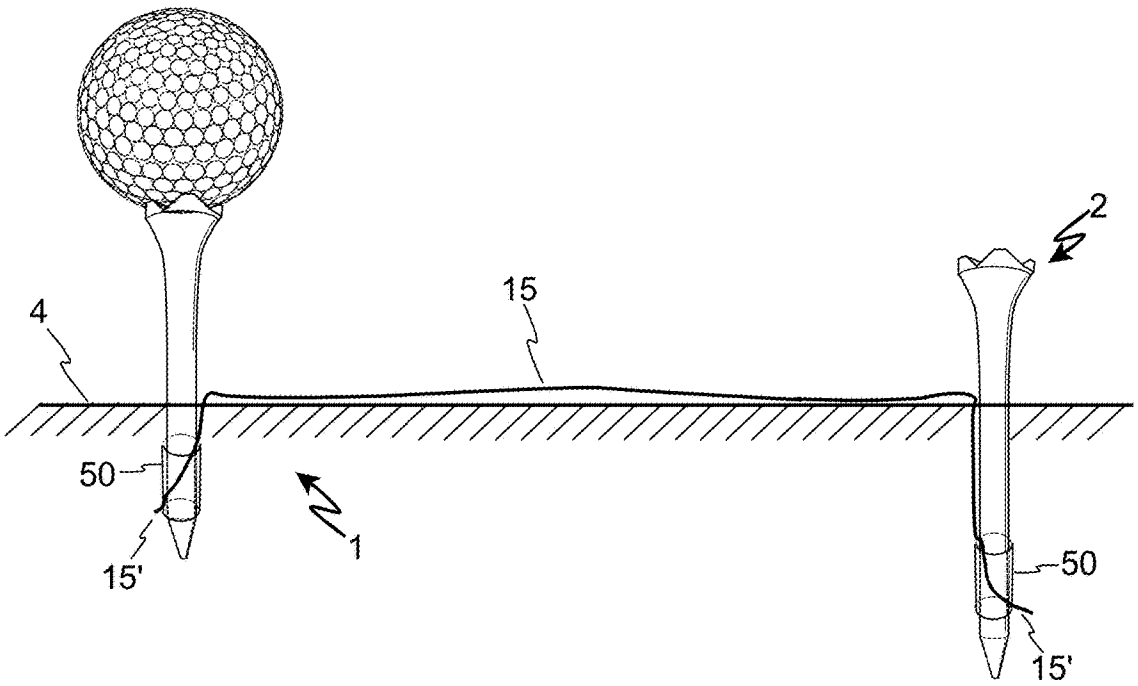
FIG. 4 illustrates an advantage of an embodiment according to the present invention which allows the golfer to set a desired tee height with the tether connection point hidden from view and planted below ground level.

In FIG. 4, an advantage of the present invention is illustrated, in which the playing piece tee (1) is sunk or planted deeply enough such that the connection point of the tether to the shank via the barrel (50) is below ground level (4). A small portion (15') of the tether (15) may extend from the barrel, or it may be trimmed off as desired. Because the barrel (50) connection method does not appreciably disturb the shape or significantly increase the diameter of the shank portion nearest to the tip portion, and because the tether material is so thin, the player will not notice that he or she has pushed the tee into the ground so far that the connection point is now sunken. Unlike bulky tee tethering systems of the past which prevent insertion into the ground because of their size, and therefore limit the tee height setting options of the player while also reminding him or her that this is not a "normal" tee, the embodiment of the present invention promotes natural "normal" play, without tactile or visual distraction to the player, and allows the player to set any tee depth he or she wishes.

Figure 5:
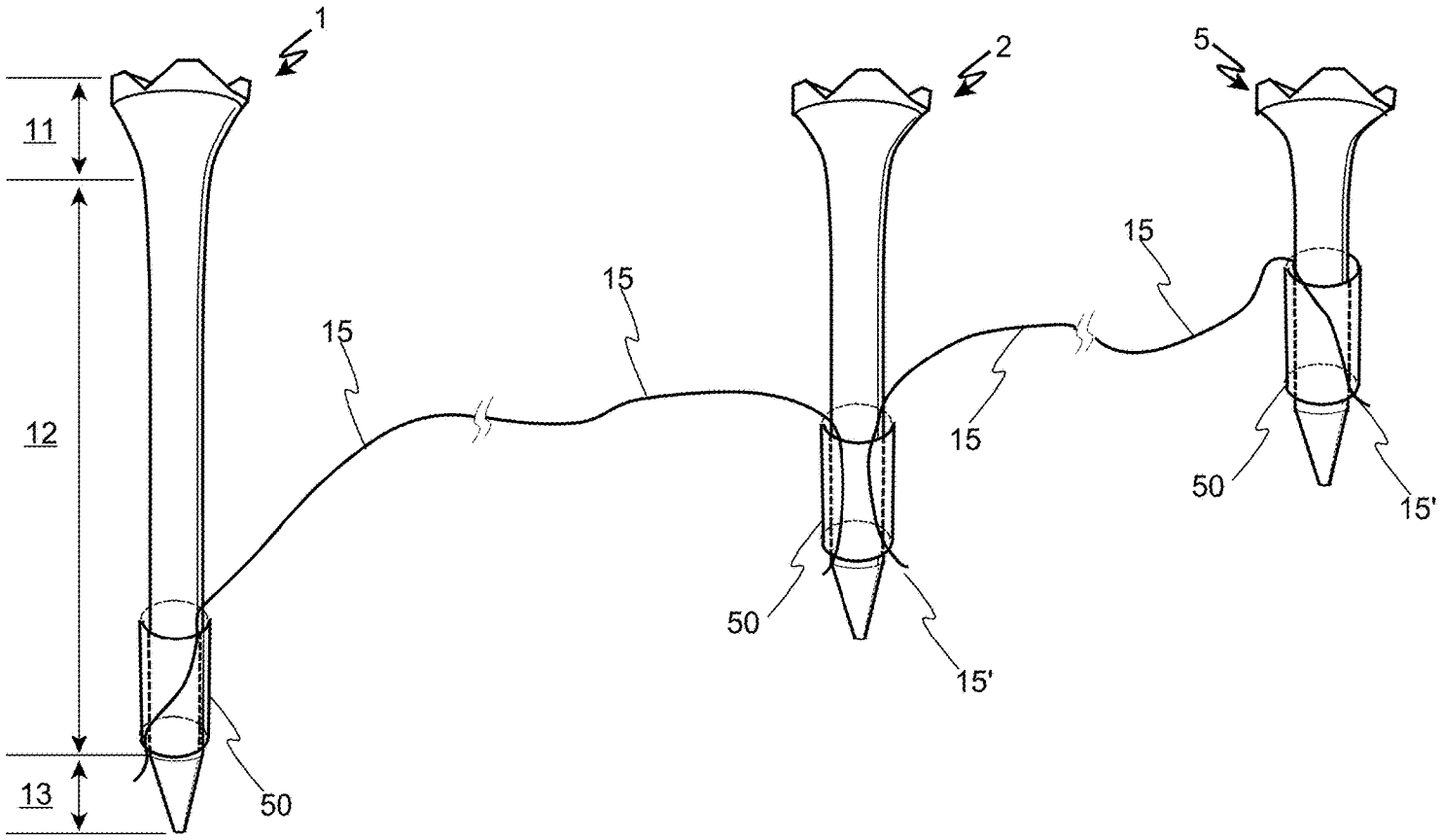
FIG. 5 illustrates another exemplary embodiment which provides two or more lengths of tethered tees as a set of tees.

An enhanced embodiment of the present invention is shown in FIG. 5 in which three tees are tethered to each other, each being of different lengths from the others. In this manner, the tee keeper not only keeps a tee which is being used, but it also provides a set of different length tees. Players who use different length tees often must dig through their club bags, pockets, or plastic bags of tees to find the length they wish, which delays play of the game and may cause frustration if the desired length is not readily found. With the multiple lengths all tethered together, the player simply plants the selected tee into the turf for play, and then selects either of the other two tees for an anchor. Similarly, each tee can be made of a variety of materials, such as wood, rigid plastic, flexible plastic, etc., such that the set of two or more tees may also offer a variety of tee materials. And, the tips (13) of the tees may vary in construction—some may be plastic or wood, while others are metal for use in harder ground types.

Figure 6:
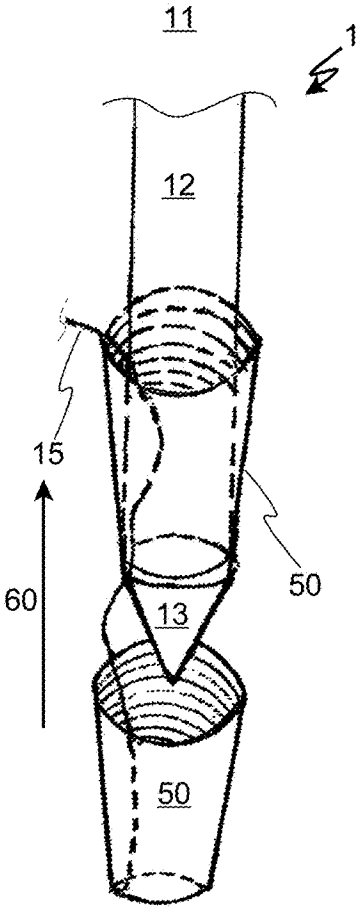
FIG. 6 illustrates a manner of providing a low-profile barrel to the tip region of a tee according to at least one embodiment of the present invention.

FIG. 6 illustrates the barrel and tether attachment according to at least one embodiment, wherein the barrel is removable. A thin-walled barrel (50) which has internal threads is passed over (60) the point portion (13) of the tee (1) and an end of the tether (15). When the internal threads of the barrel (50) come into contact with the shank portion (12) nearest the point portion (13), the end of the tether (15) is trapped between the threads and the shank. The barrel is then rotated to engage the threads into the shank portion nearest the point portion, thereby removably securing the barrel to the shank and attaching the end of the tether of the tee. In prototypes, it has been found by the present inventor that the multi-strand or multi-filament fishing line falls into the screw threads of the tee and barrel without crushing, cutting or breaking the line when the barrel is screwed onto the shank. The tail or excess length (15') of the tether extending from the barrel towards the point can be clipped or trimmed off. To change tees, the user merely unscrews the barrel, and re-attaches the barrel and tether to another tee in a like manner. Use of the barrel attachment avoids the need to drill or form a hole in the tee shank, which can weaken the strength of the tee during impact of play.

Figure 7:
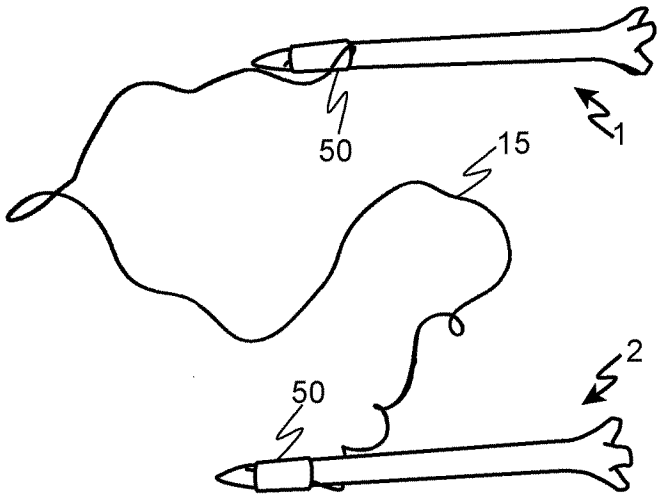
FIG. 7 is a photograph of an actual prototype tee set according to at least one embodiment of the invention.
Figure 8:
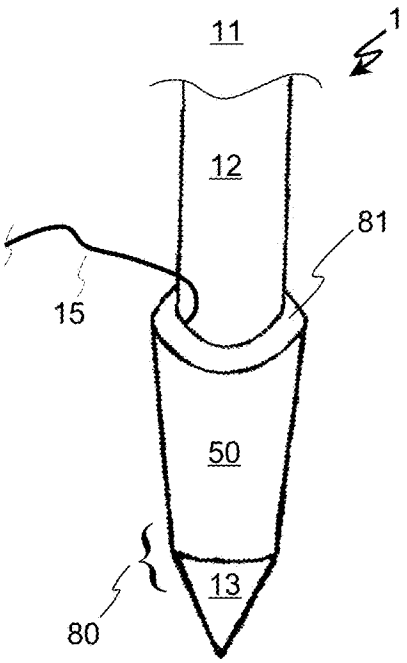
FIG. 8 illustrates the thinning and shaping of a lower or bottom edge of the barrel to match the taper of the tee's point, which avoids creating a surface discontinuity with the point and allows for ground insertion of the tee with the barrel without noticeable increased force.

FIG. 7 illustrates a prototype set of tees according to the present invention, which was constructed using two commonly-available plastic tees, about 8 inches of 20-pound test Spiderwire™ multi-strand fishing line, and two E-Z Lock™ zinc-coated metal threaded inserts with #8-32 internal threads (10 mm lengths, manufacturer part number 800832-10). The outer surface of the inserts are processed, such as by grinding, filing, polishing, etc., to remove the exterior threads, to yield a smooth exterior for the barrel. Further, as shown in FIG. 8, in at least one embodiment, the bottom edge of the barrel (50) is tapered and thinned, such as by grinding, such that the taper of the point (13) is matched. This produces a continuous taper (or flare) transitioning (80) from the point to the outer surface of the barrel. By avoiding a discontinuity in the surface, smooth insertion into the ground is provided because the surface of the ground does not encounter any discontinuities or horizontal surfaces as the tee with the barrel is planted. The barrel (50) is preferably maintained with a larger thickness at the top edge (81) than at the bottom edge, but this discontinuity in surfaces at the upper end of the barrel is not a problem for natural or "normal feeling" insertion of the tee into the ground. In other embodiments, the barrel may be manufactured specifically for this purpose without exterior threads or cleats. A tapered barrel may also be used in some embodiments.

SUMMARY

The present invention has been made to make it safer on the driving range and on the golf course. A golf tee set is designed to keep the playing tee from advancing forward off of the tee box on the driving range. If a player goes after such a tee, the player could be hit by a flying ball from another player. Using an embodiment of the present invention on the golf course keep the play from losing his or her tee as the tee comas back, falling at your feet. One of the tees is used as an anchor, while the other tee is used to hold the golf ball. Since there are two tees, it doesn't matter in most embodiments which of the tees the player uses for the anchor. During use, it is recommended that the spacing between the ball tee and the anchor tee be close enough to leave some slack in the tether. The tee set can be disassembled and reassembled to allow the user to change or replace tees, in on exemplary embodiment.

The foregoing exemplary embodiments are intended to teach how to make and use the invention, but not to express the limits of the spirit and scope of the invention. In some embodiments, a disclosed singular element may be replaced by a plurality of elements, and vice versa, without departing from the spirit and scope of the invention. Alternative materials from those disclosed in the exemplary embodiments may be employed, so long as the function and intended performance is maintained or improved.

What is claimed is:

1. A golf tee set with keeper comprising:

a first golf tee having a crown portion, a shank portion, and a point portion, wherein a first taper of the shank portion is less than a second taper of the point portion;

a second golf tee;

a tether extending between the first golf tee and the second golf tee; and a barrel attaching the tether to the first golf tee by capturing an end of the tether between an inner surface of the barrel and the shank portion, wherein the barrel is affixed to the shank portion adjacent to the point portion, and wherein a bottom edge of the barrel adjacent to the point portion is thinned and shaped to match the second taper of the point portion, thereby providing continuity from an outer surface of the point portion transitioning to an outer surface of the barrel.

2. The golf tee set as set forth in claim 1 wherein the inner surface of the barrel comprises threads which engage the shank portion.

3. The golf tee set as set forth in claim 1 further comprising:

a third golf tee; and a second tether extending between the third golf tee and the second golf tee.

4. The golf tee set as set forth in claim 3 wherein the first, second and third golf tees comprise three different tee lengths.

5. The golf tee set as set forth in claim 1 wherein the first and second golf tees comprise two different tee lengths.

6. The golf tee set as set forth in claim 1 wherein the tether comprises a multi-strand fishing line.

* * * * *